US005425161A

United States Patent [19]

Schoch

[11] Patent Number: 5,425,161

[45] Date of Patent: Jun. 20, 1995

[54] ROTARY CLOSURE FOR A SPORTS SHOE

[75] Inventor: Robert Schoch, Hilzingen, Germany

[73] Assignee: Heinz Egolf, Hinwil, Switzerland

[21] Appl. No.: 121,272

[22] Filed: Sep. 13, 1993

[30] Foreign Application Priority Data

Sep. 30, 1992 [DE] Germany ..... 9213187 U

[51] Int. Cl.[6] ..... A43C 11/16

[52] U.S. Cl. ..... 24/68 SK

[58] Field of Search ..... 24/68 SK, 69 SK, 70 SK, 24/71 SK, 71.2

[56] References Cited

U.S. PATENT DOCUMENTS 4,433,456 2/1984 Baggio .
4,633,599 1/1987 Morell et al. .
4,787,124 11/1988 Pozzobon et al. .
4,841,649 6/1989 Baggio et al. .
4,884,760 12/1989 Baggio et al. .

FOREIGN PATENT DOCUMENTS 0393380 9/1992 European Pat. Off. .

*Primary Examiner*—James R. Brittain
*Attorney, Agent, or Firm*—Learman & McCulloch

[57] ABSTRACT

Separable parts of a sports shoe are movable toward and away from one another by means of a traction cable which can be wound on and off a cable pulley which is rotatably mounted in a housing, has an engaging projection, and cooperates with a stationary stop and with a stop construction which is rotatably mounted coaxially with the pulley. The stop construction has two rotatable stop arms which enable up to almost three turns of the cable pulley between extreme positions. In this way the rotary closure is on the one hand constructed for a relatively large adjustment of length and on the other hand is secured against overstreching of the traction cable.

9 Claims, 3 Drawing Sheets

ROTARY CLOSURE FOR A SPORTS SHOE

The invention relates to a rotary closure for a ski boot or other sports shoe.

BACKGROUND OF THE INVENTION

A rotary closure of the general class disclosured herein is known from EP-A-393 380. In this case the closure flaps of a sports shoe can be drawn together and loosened by altering the effective length of a traction cable assembly in one or the other direction by a rotary movement of a rotary actuator. In order to be able to adapt the sports shoe accurately to the foot of a user, a ratchet mechanism comprising an intermediate element which is rotatable whilst maintaining a free play, a ratchet borne by this intermediate element and a gear ring worked into a housing cover is arranged between the rotary actuator and the cable pulley, wherein the cable pulley is rotated by the rotary actuator preferably with a planetary gear interposed, the sun wheel of which has a trunnion-like axial extension which extends downwards and forms a central trunnion for the cable pulley. In this case the rotary actuator can be constructed as a cap-shaped rotary handle and can be screwed to one end of the sun wheel trunnion which extends axially upwards through a housing cover, the lateral circumferential wall of the rotary handle largely covering the housing and the cover thereof towards the underside.

In this known construction, in order always to be able to achieve a reliable adaptation of the sports shoe with the longest possible cable path a construction is proposed which allows approximately two turns of the cable pulley, a stop construction in the form of one single stop arm being used in such a way that shortly before the completion of the second turn of the cable pulley it comes into engagement with a stationary housing stop, thus limiting the further rotary movement of the cable pulley.

In practice it has proved desirable in many applications for the effective length of the traction cable assembly to be somewhat increased.

The object of the invention, therefore, is to provide an improved rotary closure while retaining the advantages of the previously known construction in such a way that with a relatively simple design a rotary movement of the cable pulley over more than two turns is made possible.

SUMMARY OF THE INVENTION

In this rotary closure according to the invention the stop construction is essentially formed by tewo flat stop arms which are arranged one above the other and rotatably mounted coaxially with one another about the central housing axis. Of these, the upper first stop arm lies immediately below the cable pulley, the engaging projection of which is constructed and arranged in such a way that after the first turn of the cable pulley and during continuation of this rotary movement it only comes into engagement with the first stop arm and the cable pulley can then carry out a second turn together with this first stop arm. The lower second stop arm is in engaged connection with the first stop arm by means of an engaging cam in such a way that it only takes effect after a second turn of the cable pulley and during a further continuation of this rotary movement. However, in this case the stationary housing stop is arranged in the path of movement of the second stop arm at a point which lies just before the completion of a complete turn of this second stop arm. Thus by this construction and arrangement according to the invention the cable pulley can carry out in all a maximum of approximately three turns, for example approximately a good two and three-quarter turns, before further rotary movement is prevented or limited by the stationary housing stop (the latter occurs in order to prevent damage to a traction cable due to overstretching).

THE DRAWINGS

The invention will be explained in greater detail below with the aid of the drawings, in which.

DETAILED DESCRIPTION

Figure 1:
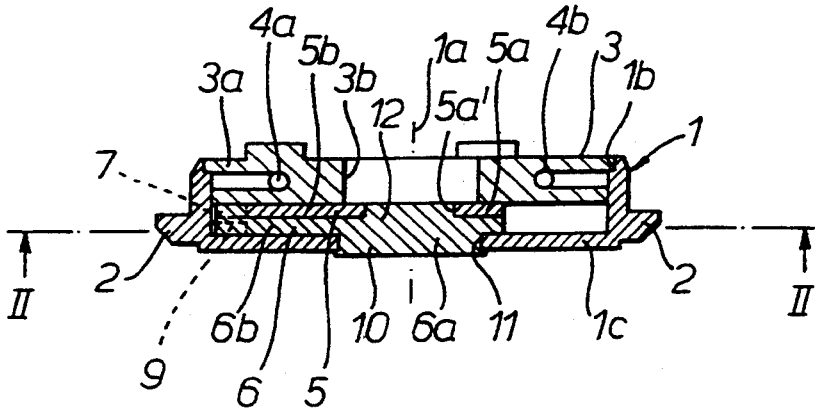
FIG. 1 is a vertical sectional view align the lines I—I in FIG. 2 of the lower part of the rotary closure according to the invention.

The rotary closure according to the invention can be attached or fastened to the upper of any suitable sports shoe so that the traction cable arrangement can be connected in a favourable manner to closure flaps or other parts of the sports shoe which can be drawn together, in order thereby to be able to adapt the shoe accurately to the foot of a user.

As far as the lower part which contains a cable pulley as well as a stop arrangement which co-operates therewith, this rotary closure according to the invention can be constructed in the same way as in the previously described EP-A-393 380, so that in the drawings only the lower part of this rotary closure which is crucial to the invention is illustrated, whilst the upper part with the ratchet mechanism, rotary actuator, cover etc. is of the same design as in the aforementioned known construction, to which reference is expressly made.

In order to explain the general construction of this rotary closure, particularly the lower part of this rotary closure, reference will be made first of all to FIGS. 1 and 2.

The lower part of the rotary closure has a somewhat dishshaped and substantially circular housing 1 which can be fastened in a suitable manner onto the upper of a sports shoe which is not shown in greater detail, for example with the aid of lateral fastening flaps 2. A cable pulley 3 which can be actuated so as to rotate about a central housing axis 1 is rotatably mounted in the housing 1, and a traction cable 4 can be wound or unwound —depending upon the rotary movement—on this cable pulley in order thereby to be able to alter the effective length of the traction cable 4 in the desired manner. In the example according to FIG. 2 two traction cable ends 4*a*, 4*b*, which can belong to one single traction cable or also to two traction cables, are fastened on the cable pulley 3.

As can be seen from FIG. 1, the cable pulley 3 is received in the housing 1 so that the outer circumferential edge of the upper part 3*a* thereof fits in a kind of annular groove 1*b* on the upper edge of the housing. The cable pulley 3 has a central bore 3*b* into which protrudes a downwardly-extending trunnion-like axial extension of a sun wheel which is not shown in greater detail of a planetary gear belonging to the rotary actuation arrangement, this trunnion-like extension forming a central trunnion for the cable pulley 3.

A stop construction is rotatably mounted in the housing coaxially and below the cable pulley 3 and is essentially formed by two flat stop arms which are arranged one above the other and rotatably mounted coaxially with one another about the central housing axis 1*a*, namely an upper first stop arm 5 and a lower second stop arm 6.

The upper first stop arm 5 has a central bearing portion 5*a* and an outer stop portion 5*b* which adjoins the latter radially outwards and is in the shape of a circular sector, and in approximately the same way has a central bearing portion 6*a* as well as an outer stop portion 6*b* which adjoins the latter radially outwards and is in the shape of a circular sector. On the upper face of the lower second stop arm 6 and on the peripheral edge thereof an engaging cam 7 is fixed which projects upwards, the height thereof being at most as great as the material thickness of the upper stop arm 5, which can be seen in FIG. 1 (left-hand half). On the other hand, an engaging projection 8 is fixed on the underside of the cable pulley 3 in the region radially within the engaging cam 7 and is at most as high as the material thickness of the first stop arm 5.

Furthermore, within the housing 1 a stationary stop 9 is provided on the housing base 1*c* as well as in the peripheral edge region and serves to limit the rotary movement of the lower second stop arm 6 and thus—as will be explained in greater detail—also limits the rotary movement of the cable pulley 3 in both directions. In this case this housing stop 9 extends upwards from the housing base 1*c* by a dimension which is at most as great as the material thickness of the lower second stop arm 6.

With the dimensions and co-ordination of the two stop arms 5, 6 and the cable pulley 3 in the housing 1 as explained above it is ensured that the stationary housing stop 9 only limits the rotary movement of the lower stop arm 6 but not the rotary movement of the first stop arm 5 lying below it and of the cable pulley 3. The rotary movement of the upper first stop arm 5, on the other hand, is limited by the upwardly-projecting engaging cam 7 of the lower second stop arm 6, but this engaging cam 7 does not hinder the rotary movement of the cable pulley 3.

As regards the mounting of the individual rotatable parts, any suitable construction can be provided so long as it is ensured that the cable pulley 3 and the two stop arms 5, 6 are rotatable independently of one another about the central housing axis 1*a* in the necessary manner in each case. In the preferred embodiment shown in FIG. 1 the central bearing portion 6*a* of the second stop arm 6 has a circular bearing lug 10 which extends axially downwards and which is slidably mounted and guided in a central bearing bore 11 in the housing base 1*c*. In this case at least the remaining part of the central bearing portion 6*a* of this second stop arm 6, but preferably at least the greater part of the outer stop portion 6*b*, is slidably supported on the housing base 1*c*.

On the other hand the central bearing portion 5*a* of the upper first stop arm 5 is rotatably mounted and guided on the central bearing portion 6*a* of the second stop arm 6. For this purpose the central bearing portion 6*a* of the second stop arm 6 also has a trunnion 12 which extends upwards coaxially with the bearing lug 10 and protrudes to fit into a central bearing bore 5' in the bearing portion 5*a* of the upper first stop arm 5, so that a reliable rotary mounting and guide is created in an extremely simple manner for this bearing portion 5*a* and thus also for the entire upper first stop arm 5.

With regard to the overall construction of the rotary closure it may also be stated in this connection that it can be produced at least partially from a suitable plastics material, preferably one which can be cast and machined. In this case with a view to relatively simple and economical production it is also particularly advantageous if at least the housing 1, the cable pulley 3 and the stop arms 5, 6 are made from such plastics material.

A process for winding up the traction cable arrangement 4 or the traction cable ends 4*a* and 4*b* on the cable pulley 3 is explained below with the aid of FIGS. 2 to 5, and it should again be emphasised that these FIGS. 2 to 5 show horizontal sectional views from below corresponding to the section line II—II in FIG. 1. In FIG. 2 the zero position is shown in which the traction cable 4 is completely unwound from the cable pulley. In this case the outer stop portion 6*b* rests on one side of the stationary housing stop 9, whilst the outer stop portion 5*b* of the upper first stop arm 5 rests on one side of the engaging cam 7 and in turn the engaging projection 8 of the cable pulley rests on one side of the outer stop portion 5*b*. If the traction cable arrangement 4 or the traction cable ends 4*a* and 4*b* thereof are to be wound onto the cable pulley 3, then the cable pulley 3 is rotated in the direction of the arrow 13 by the rotary actuation arrangement explained in the introduction.

Figure 2:
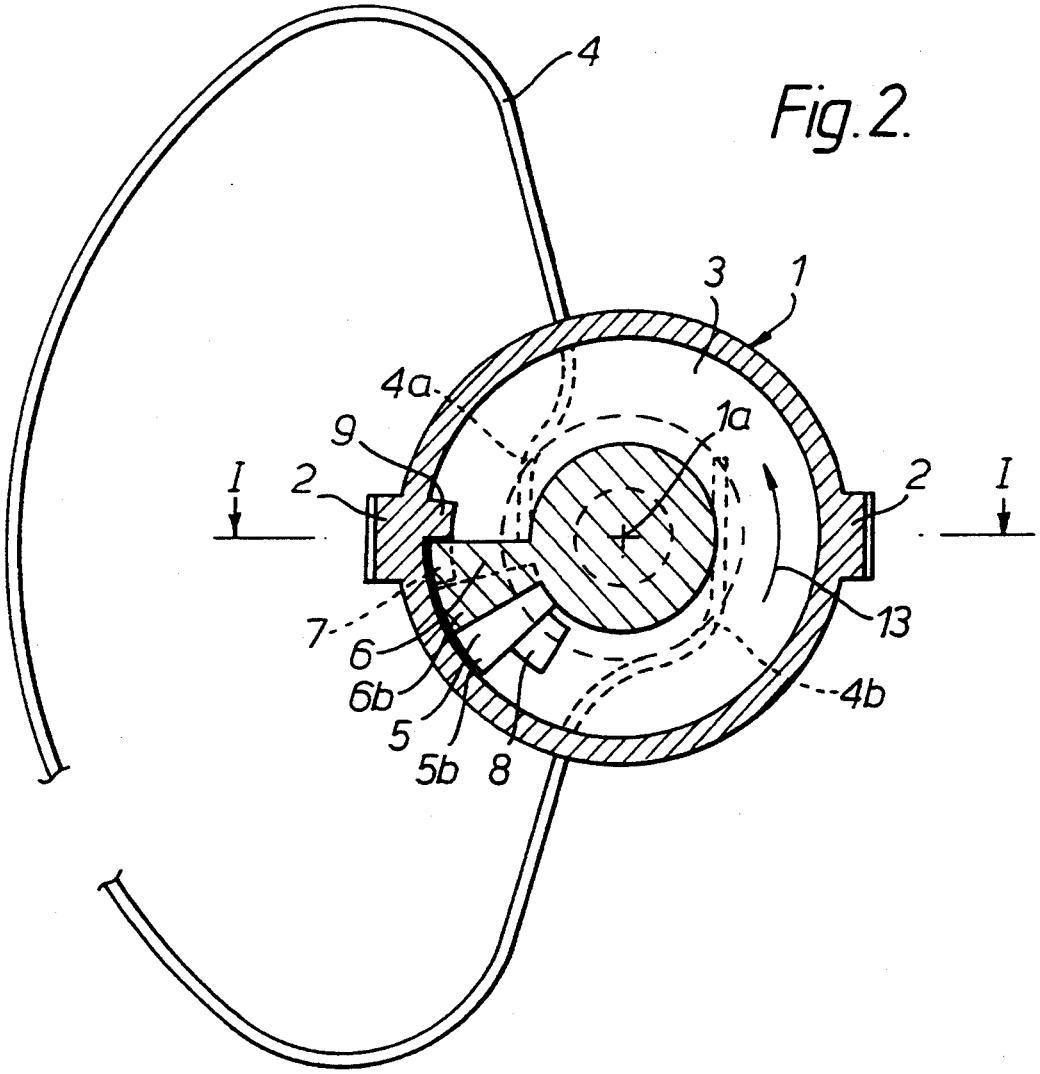
FIG. 2 is a horizontal sectional view (from below) approximately along the section line II—II in FIG. 1.
Figure 3:
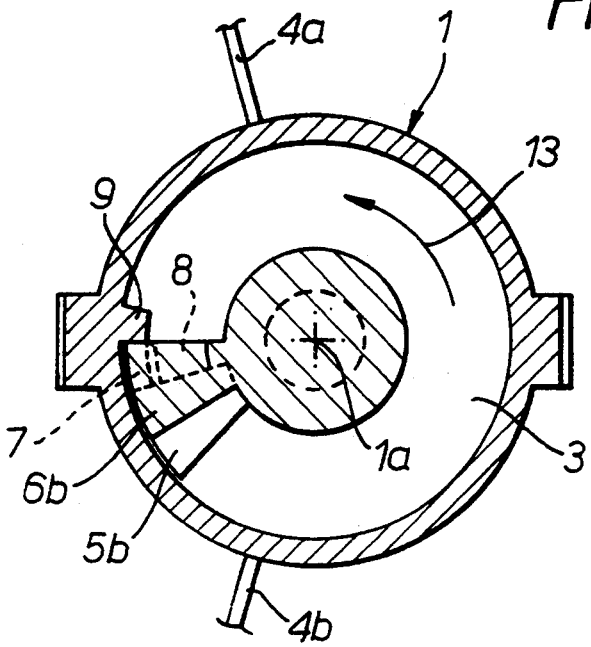
FIGS. 3 to 5 are similar horizontal sectional views to FIG. 2, but in different rotated positions of the cable pulley and stop arms.
Figure 4:
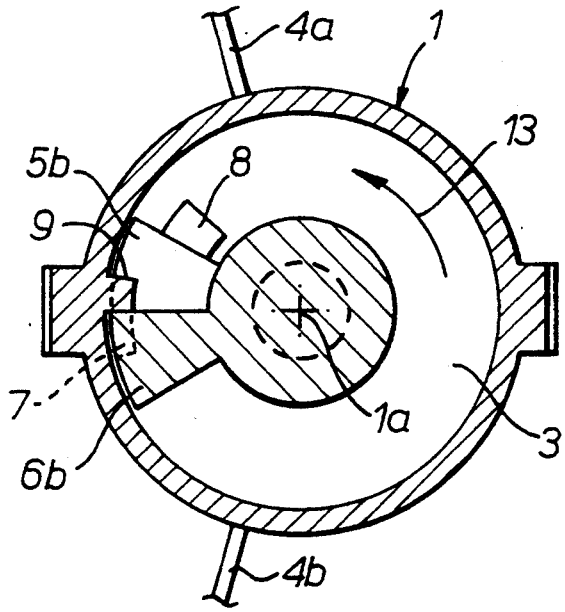
Figure 5:
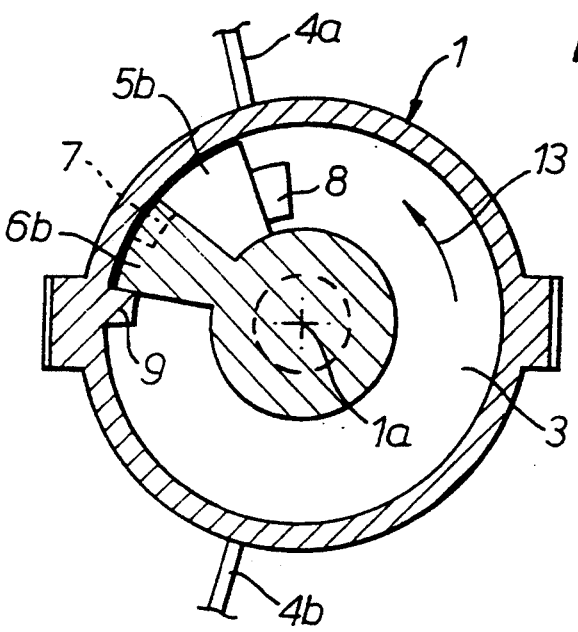

After approximately one turn of the cable pulley 3 the latter reaches the position shown in FIG. 3 in which the engaging projection 8 of the cable pulley 3 comes to rest on the opposite side—relative to the position in FIG. 2—of the outer stop portion 5*b* of the upper first stop arm 5. When this rotary movement of the cable pulley 3 is continued in the direction of the arrow 13 only the first stop arm 5 is entrained so that after approximately a second turn of the cable pulley 3 the position shown in FIG. 4 is reached. Only after this second turn of the cable pulley 3 does the side of the outer stop portion 5*b* of the first stop arm 5 lying opposite the engaging projection 8 come into engagement (engaged connection) with the engaging cam 7. If this rotary movement of the cable pulley 3 is continued in the direction of the arrow 13, then the cable pulley 3 does not only entrain the upper first stop arm 5 with its engaging projection 8 but—via the engaged connection explained above—also entrains the lower second stop arm 6. Just before the completion of this second rotary movement of the cable pulley 3 and thus just before a complete turn of this second stop arm 6 the latter comes to rest on the opposite side—in comparison to the zero position in FIG. 2—of the stationary housing stop 9, as shown in FIG. 5, as a result of which a further rotary movement of the cable pulley 3 as well in the direction of the arrow 13 is prevented. Thus the cable pulley 3 can carry out almost three turns in order to wind up the cable ends 4*a* and 4*b* of the traction cable arrangement 4, so that a particularly large clearance for opening and closing an appertaining sports shoe is produced if required.

In the function of winding up the traction cable 5 described above with the aid of FIGS. 2 to 5 it may be easily imagined how the traction cable 4 and with it the cable ends 4*a* and 4*b* thereof can be unwound from the cable pulley 3 in the opposite direction of rotation (against the arrow 13).

Figure 6:
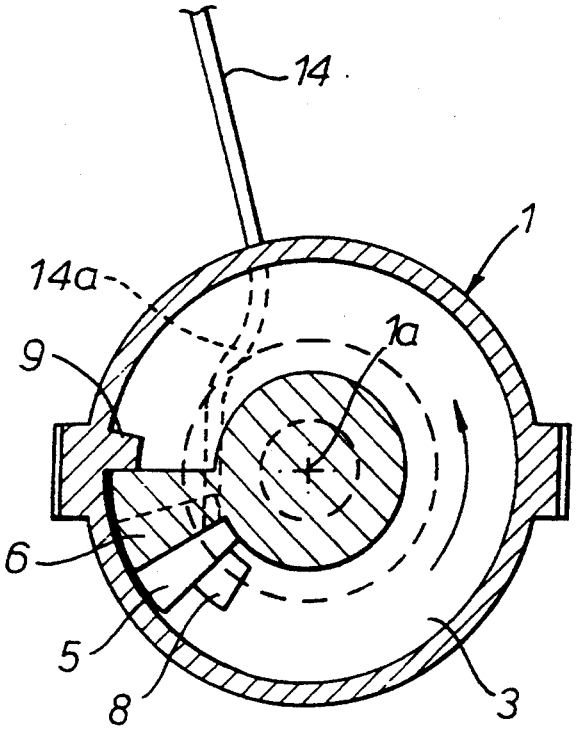
FIG. 6 is a horizontal sectional view similar to FIG. 2, but with only one end of the traction cable arranged on the cable pulley.

It may be briefly pointed out with the aid of FIG. 6 that with an otherwise similar construction of the rotary closure the possibility also exists if required of forming the traction cable of one single traction cable 14, of which one cable end 14*a* can be wound or unwound on the cable pulley 3 in the same way as has been described above. Therefore in this FIG. 6 only some elements of the lower part of the rotary closure are provided with reference numerals which correspond to those of the first embodiment described above, so that no more detailed explanations thereof are required.

I claim:

1. In a rotary closure for a sports shoe having a) a traction cable which can be connected to parts of the shoe which are to be drawn together, b) a housing for fastening on the shoe and in which a cable pulley is rotatably mounted about a central housing axis for winding the traction cable on and off, the said cable pulley having an engaging projection on its underside, c) a stop construction rotatably mounted in the housing coaxially with and below the cable pulley and which, after a first turn of the cable pulley in one direction, may be entrained by said engaging projection when the rotary movement is continued, and d) a stationary stop on the housing to limit the rotary movement of the cable pulley and the stop construction in both directions of rotation, the improvement wherein e) the stop construction has upper and lower stop arms arranged one above the other and rotatably mounted coaxially with one another about the central housing axis;

f) the upper stop arm being immediately below the cable pulley and the engaging projection being constructed and arranged in such a way that after the first turn of the cable pulley in said one direction and during continuation of rotary movement in said one direction said engaging projection comes into engagement with the upper stop arm;

g) the lower stop arm being engageable with the upper stop arm by means of an engaging cam only after a second turn of the cable pulley in said one direction, the stationary stop being positioned in the path of movement of the lower stop arm at a point which lies just before the completion of a complete turn of the lower stop arm.

2. Rotary closure as claimed in claim 1, characterised in that each stop arm has a central bearing portion and an outer stop portion in the shape of a circular sector, wherein the engaging cam has a height which is at most as great as the thickness of the upper stop arm and is mounted on the lower stop arm at its peripheral edge, and wherein the engaging projection is mounted radially inward of the engaging cam and on the underside of the cable pulley and is at most as high as the thickness of the upper stop arm the stationary stop extending upwards into the housing a distance from its base which is at most as great as the thickness of the lower stop arm.

3. Rotary closure as claimed in claim 2, characterised in that the central bearing portion of the lower stop arm has a circular bearing lug which extends downwards and is slidably mounted and guided in a central bearing bore in the housing base.

4. Rotary closure as claimed in claim 3, characterised in that the lower stop arm is slidably supported at least in the region of its central bearing portion on the housing base.

5. Rotary closure as claimed in claim 3, characterised in that the central bearing portion of the upper stop arm is rotatably mounted and guided on the central bearing portion of the lower stop arm.

6. Rotary closure as claimed in claim 5, characterised in that the central bearing portion of the lower stop arm has a trunnion extending upwards coaxially with the bearing lug for rotary mounting and guiding of the central bearing portion of the upper stop arm.

7. Rotary closure as claimed in claim 1, characterised in that at least the housing, the cable pulley and the stop arms are produced from plastics material.

8. Rotary closure as claimed in claim 1, characterised in that said traction cable has two ends each of which is fastened on the cable pulley.

9. Rotary closure as claimed in claim 1, characterized in that at least one end of said traction cable end is fastened on the cable pulley.

* * * * *